US008621823B2

(12) United States Patent
Mears

(10) Patent No.: US 8,621,823 B2
(45) Date of Patent: Jan. 7, 2014

(54) FURRING CHANNEL FRAMING MEMBER

(75) Inventor: Charles Mears, White Bear Lake, MN (US)

(73) Assignee: Radius Track Corporation, Coon Rapids, MN (US)

( * ) Notice: Subject to any disclaimer, the term of this patent is extended or adjusted under 35 U.S.C. 154(b) by 0 days.

(21) Appl. No.: 13/587,732

(22) Filed: Aug. 16, 2012

(65) Prior Publication Data

US 2013/0042571 A1 Feb. 21, 2013

Related U.S. Application Data

(60) Provisional application No. 61/524,178, filed on Aug. 16, 2011.

(51) Int. Cl.
*E04C 2/38* (2006.01)

(52) U.S. Cl.
USPC ..... 52/846; 52/481.1; 52/836

(58) Field of Classification Search
USPC ..... 52/85, 204.57, 245, 270, 481.1, 482, 52/483.1, 716.1, 716.8, 836, 846
See application file for complete search history.

(56) References Cited

U.S. PATENT DOCUMENTS

| | | | | |
|---|---|---|---|---|
| 3,333,379 | A | 8/1967 | Harris | |
| 3,477,187 | A * | 11/1969 | Fruman | 52/346 |
| 4,333,290 | A | 6/1982 | Koberstein | |
| 4,757,663 | A | 7/1988 | Kuhr | |
| 5,129,204 | A * | 7/1992 | Palumbo | 52/846 |
| 6,088,988 | A * | 7/2000 | Sahramaa | 52/639 |
| 6,115,984 | A * | 9/2000 | Paradis | 52/717.03 |
| 6,237,301 | B1 | 5/2001 | Paradis | |
| 7,293,392 | B2 | 11/2007 | Krumbacher | |
| 7,458,188 | B2 | 12/2008 | Mears | |
| 7,647,737 | B2 * | 1/2010 | Morello | 52/245 |
| 8,056,303 | B2 * | 11/2011 | Frobosilo | 52/852 |
| 8,225,581 | B2 * | 7/2012 | Strickland et al. | 52/850 |

OTHER PUBLICATIONS

Soundaway Corporation, "Drywall Furring Hat Channel, 25 Gauge, ⅞" height ×10' length", http://www.soundaway.com/drywall_furring_hat_channel_p/13201.htm, Copyright 2012 (last visited Aug. 11, 2011).

Soundproofing Company, Inc., "Furring Channel with Resilient Sound Clips", http://www.soundproofingcompany.com/soundproofing101/furring-channel-with-resilient-sound-clips/, page created 2009 (last accessed Aug. 11, 2011).

* cited by examiner

*Primary Examiner* — Brian Glessner
*Assistant Examiner* — Adam Barlow
(74) *Attorney, Agent, or Firm* — Haugen Law Firm PLLP

(57) ABSTRACT

A furring channel framing member for use with joists or studs of a structural support framework for a wall or ceiling includes one or more creases placed specifically to provide a location for curvature of the framing member. In some cases, the one or more creases may establish a flex joint that permits hand-bending of the framing member about such flex joint to create a desired curved configuration for the furring channel framing member. The creases may also or instead placed at pre-determined intervals in a manner that, through the creases themselves, establish a curvilinear configuration of the framing member.

16 Claims, 10 Drawing Sheets

FURRING CHANNEL FRAMING MEMBER

CROSS-REFERENCE TO RELATED APPLICATIONS

This application claims priority to U.S. Provisional Patent Application Ser. No. 61/524,178, filed on Aug. 16, 2011 and entitled "Furring Channel Framing Member," the content of which being incorporated herein in its entirety.

FIELD OF THE INVENTION

The present invention relates to structural support devices generally, and more particularly to furring channel framing members which may be configured to be sufficiently flexible to be hand-bendable, even when formed from relatively thick gauge material. Such hand-bendable furring channel framing members are particularly suitable in the construction of non-planar structures. Other furring channel framing members of the present invention are curved to a pre-determined extent and configuration with creases placed at certain locations of the framing members.

BACKGROUND OF THE INVENTION

In light-frame construction, furring strips are long thin strips of wood or metal used to make backing surfaces to support the finished surfaces in a room. The term "furring" refers to the backing surface, the process of installing it, and may also refer to the strips themselves. Typically, furring strips may be laid out and secured perpendicularly to studs or joists, or simply set against an existing wall surface.

In metal framing systems, furring members are formed as generally U-shaped channels, which are often referred to as "hat channels". The furring channels are typically secured to structural support members, such as studs, to serve as a mounting location for gypsum board, plywood, drywall, or the like. Such a furring system is widely employed in the construction of walls and ceilings, and have found particular use in sound isolation applications, wherein the finishing surface may be spaced from, and acoustically isolated from, the support framing.

In some applications, furring systems are employed to established curved wall and ceiling constructions. To accommodate the necessary furring channel bending, conventional approaches typically utilize a resilient furring channel material, or a furring channel with a sufficiently thin material gauge to render the overall structure suitably flexible to accommodate bending into a curved configuration. Currently available products, however, are either too flexible to support long-span bridging in large-scale construction projects, or are too inflexible to permit on-site bending, and therefore rely upon custom-bending from the manufacturer to meet specific curve criteria of the construction project. Conventional products, therefore, do not provide for furring channels that possess substantial structural integrity, while nonetheless being hand-bendable at the construction site to permit custom-curving by the installer.

It is therefore an object of the present invention to provide a furring channel framing member that is sufficiently flexible to permit custom-curving of the member by an installer at the construction site. It is a further object to provide the furring channel framing member with sufficient material rigidity to establish a curved structural support member across relatively large spans.

Another object of the present invention is to provide a custom-curved furring channel framing member.

SUMMARY OF THE INVENTION

By means of the present invention, a furring channel framing member may be custom-curved at the installation site without the need for channel bending equipment. The hand-bendable structural framing member is specifically configured to provide both strength and flexibility in a custom-modifiable configuration. The furring channel framing member of the present invention, therefore, may be operably positioned in a curved arrangement as, for example, a convenient mounting location for wall or ceiling finishing materials to form a non-planar finished surface.

In a particular embodiment, the furring channel framing member of the present invention includes a base having first and second side edges, a length, and a first crease extending between the first and second side edges and having a first apex that is spaced from a plane of a portion of the base adjacent to the first crease. The framing member further includes first and second legs extending respectively from the first and second side edges from the base and along the length to form a channel bounded by the base and the first and second legs. The first leg includes a second crease, and the second leg includes a third crease. A first flange extends outwardly from the first leg along a first direction, and includes a fourth crease, and a second flange extends outwardly from the second leg along a second direction that is substantially opposite to the first direction, wherein the first and second flanges are substantially parallel to the base. The second flange includes a fifth crease, wherein the first, second, third, fourth, and fifth creases together form a flex joint. The framing member may include a plurality of the flex joints spaced apart along the length to define one or more discrete zones between adjacent sets of two of the flex joints.

In another aspect of the present invention, a furring channel framing member may be custom-curved to a specific pre-determined extent with creases placed at certain locations of the furring channel framing member. While not necessarily hand-bendable, such framing members are useful for establishing a curved surface against which to mount wall or ceiling finishing materials.

A furring channel framing member for use with joists or studs of a structural support framework for a wall or ceiling includes a base having an outer surface and an inner surface, first and second side edges, and a length. The furring channel framing member further includes first and second legs extending respectively from the first and second side edges of the base and along the length to form a channel bounded by the base and the first and second legs. Each of the first and second legs extend from a respective one of the first and second side edges to respective first and second terminus edges. A first flange extends outwardly from the terminus edge of the first leg along a first direction, and a second flange extends outwardly from the terminus edge of the second leg along a second direction that is substantially opposite to the first direction, and wherein the first and second flanges are substantially parallel to the base. The furring channel framing member further includes at least one of a first crease in the base extending between the first and second side edges and having a first apex spaced from a plane of a portion of the base adjacent to the first crease, and a flange crease extending from the terminus edge from the first leg along a first direction. The flange crease includes a second apex that is spaced from a plane of a portion of the first flange adjacent to the flange crease. The furring channel framing member forms a curvilinear surface extending between the joists or studs of the structural support framework.

DETAILED DESCRIPTION OF THE PREFERRED EMBODIMENTS

The objects and advantages enumerated above together with other objects, features, and advances represented by the present invention will now be presented in terms of detailed embodiments described with reference to the attached drawing figures which are intended to be representative of various embodiments of the invention. Other embodiments and aspects of the invention are recognized as being within the grasp of those having ordinary skill in the art.

Figure 1:
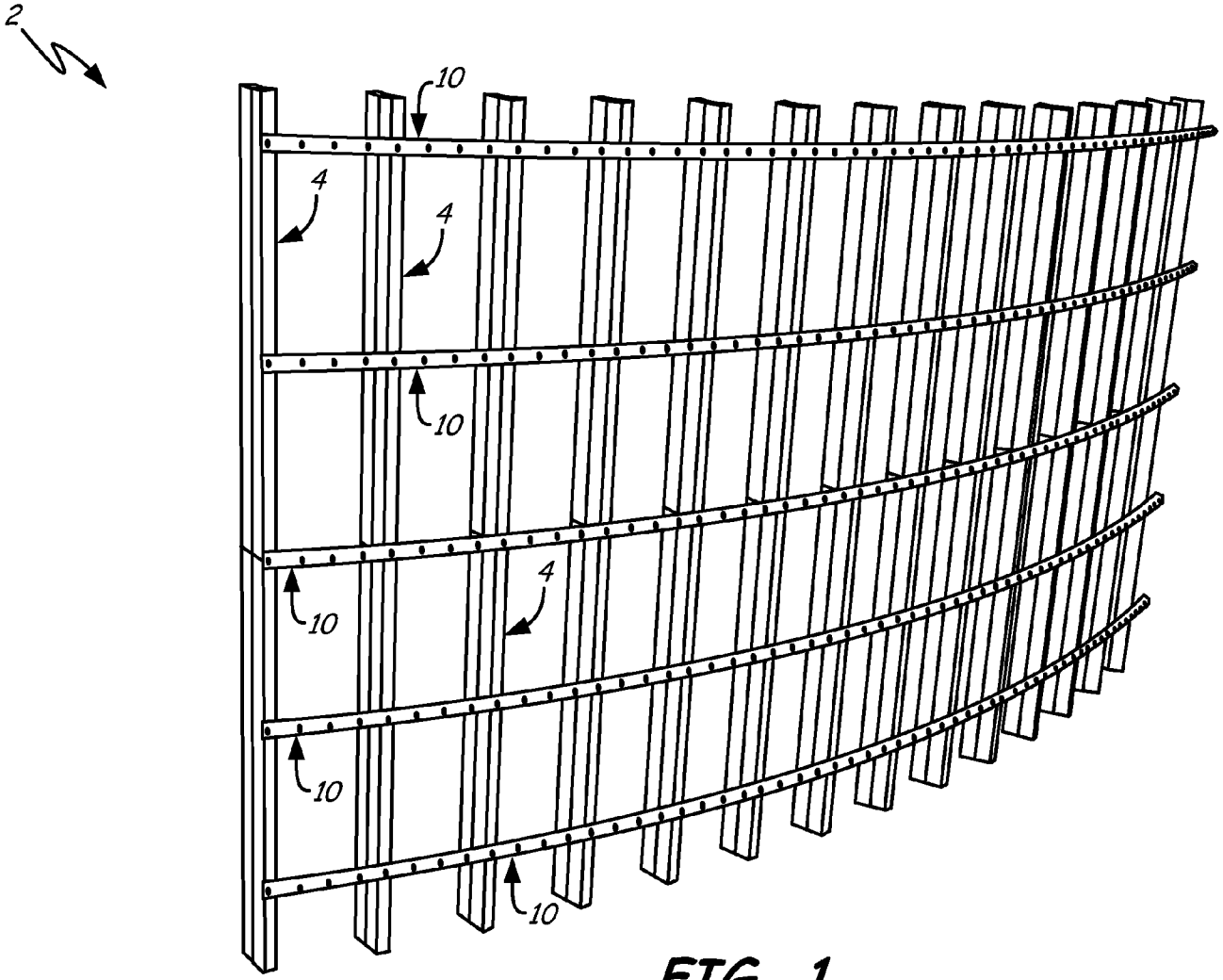
FIG. 1 is a schematic illustration of a support structure framing assembly incorporating the furring channel framing members of the present invention.

With reference now to the drawing figures, and first to FIG. 1, a non-planar structural support assembly 2 may be efficiently constructed with the devices of the present invention. Non-planar structural support assembly 2 may be arranged to support finishing materials, such as drywall, gypsum board, wood paneling, and the like in a non-planar configuration for, e.g. walls and ceilings. In the example embodiment illustrated in FIG. 1, non-planar structural support assembly 2 includes a plurality of furring channel framing members 10 each arranged in a curvilinear configuration and secured to structural framing studs 4. The resultant assembly establishes suitable surfaces upon which to securely anchor finishing materials to assembly 2 in a non-planar configuration.

Figure 2:
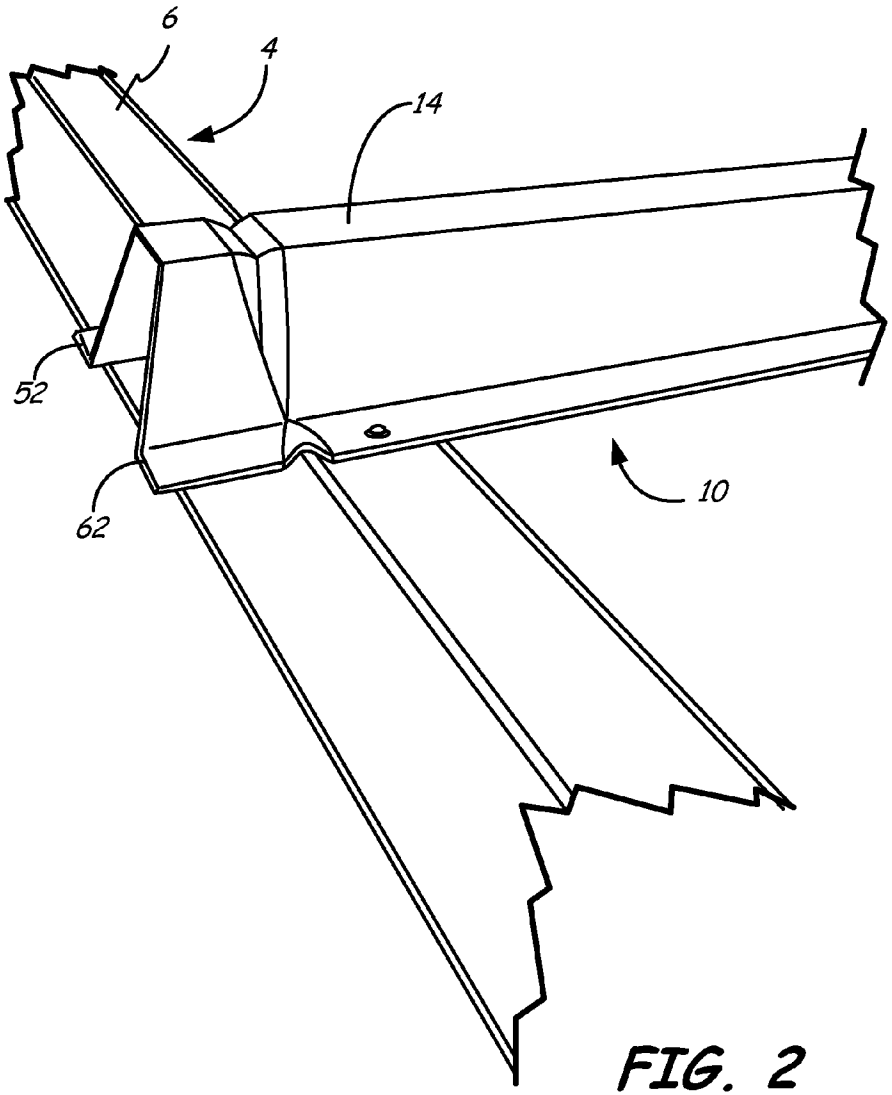
FIG. 2 is an enlarged view of the assembly illustrated in FIG. 1.
Figure 3:
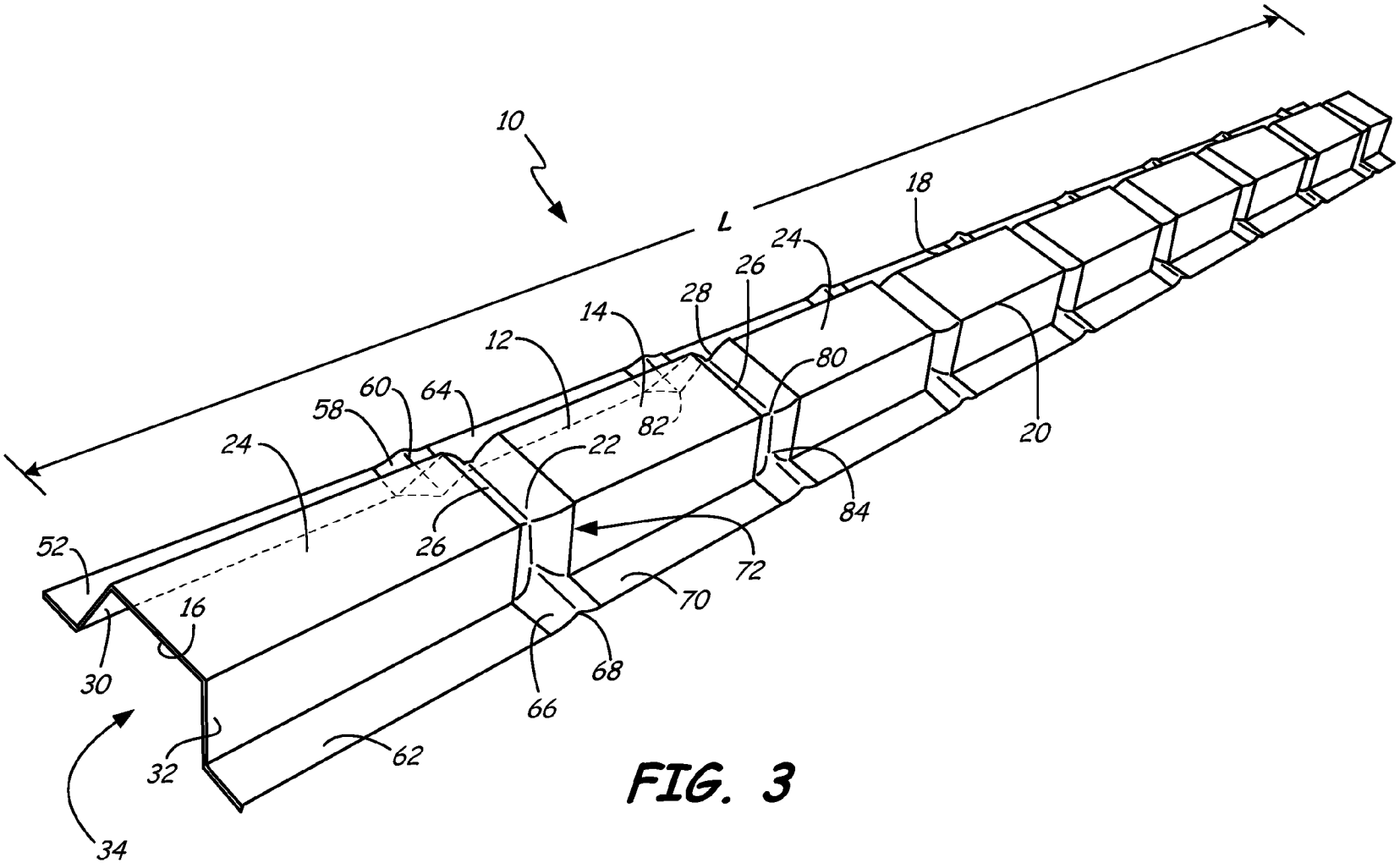
FIG. 3 is an isolation top perspective view of a furring channel framing member of the present invention.
Figure 4:
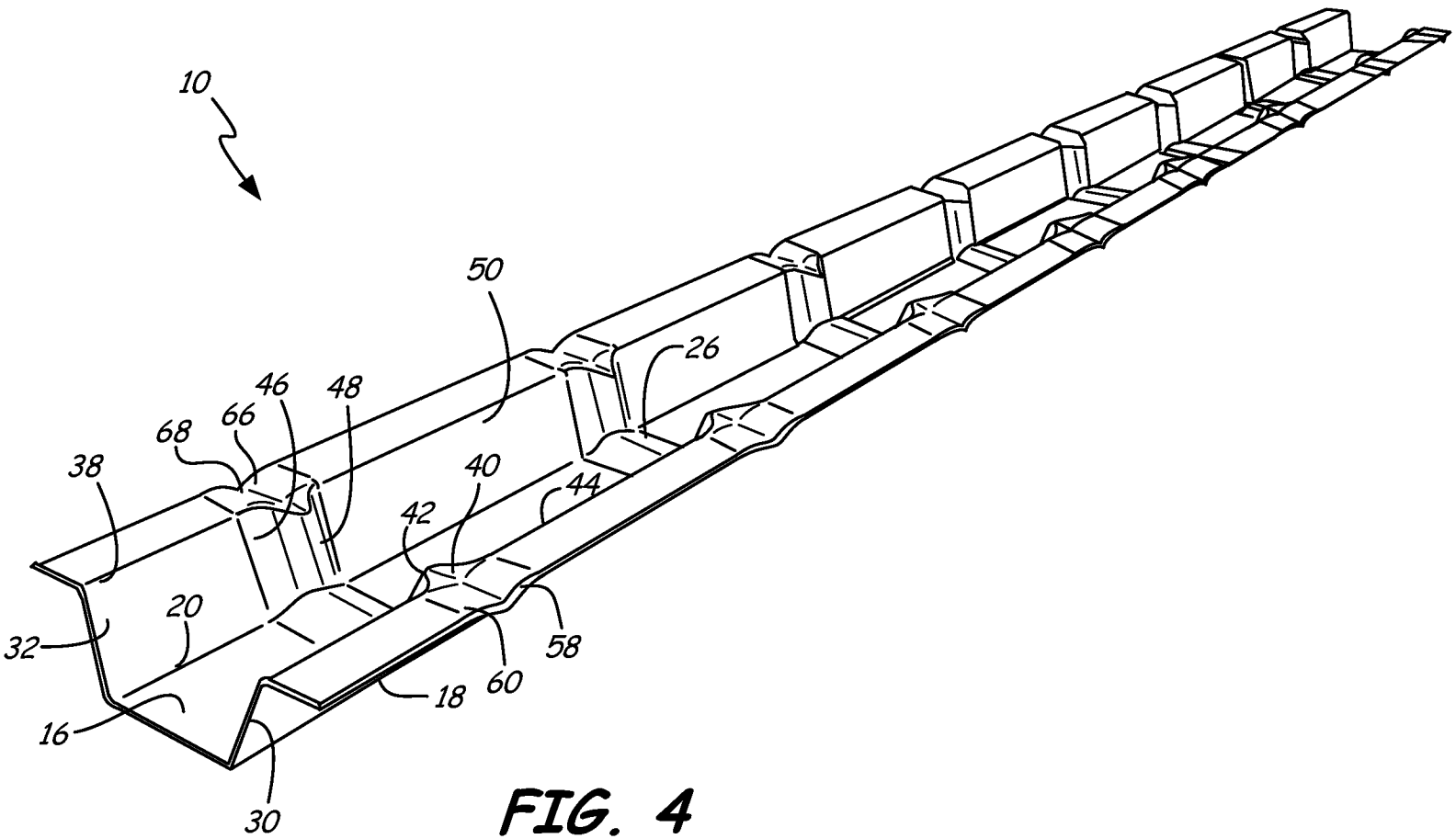
FIG. 4 is an isolation bottom perspective view of a furring channel framing member of the present invention.
Figure 5A:
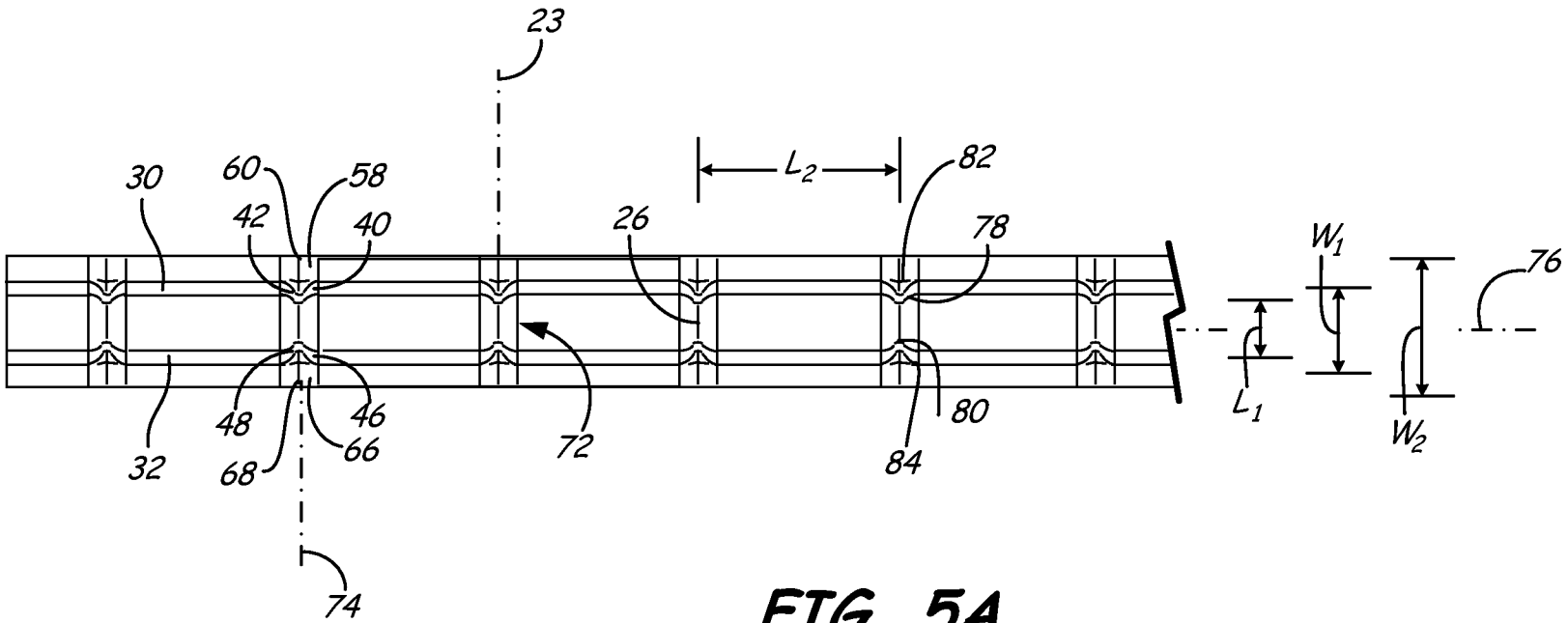
FIG. 5A is an isolation top plan view of a furring channel framing member of the present invention.
Figure 5B:
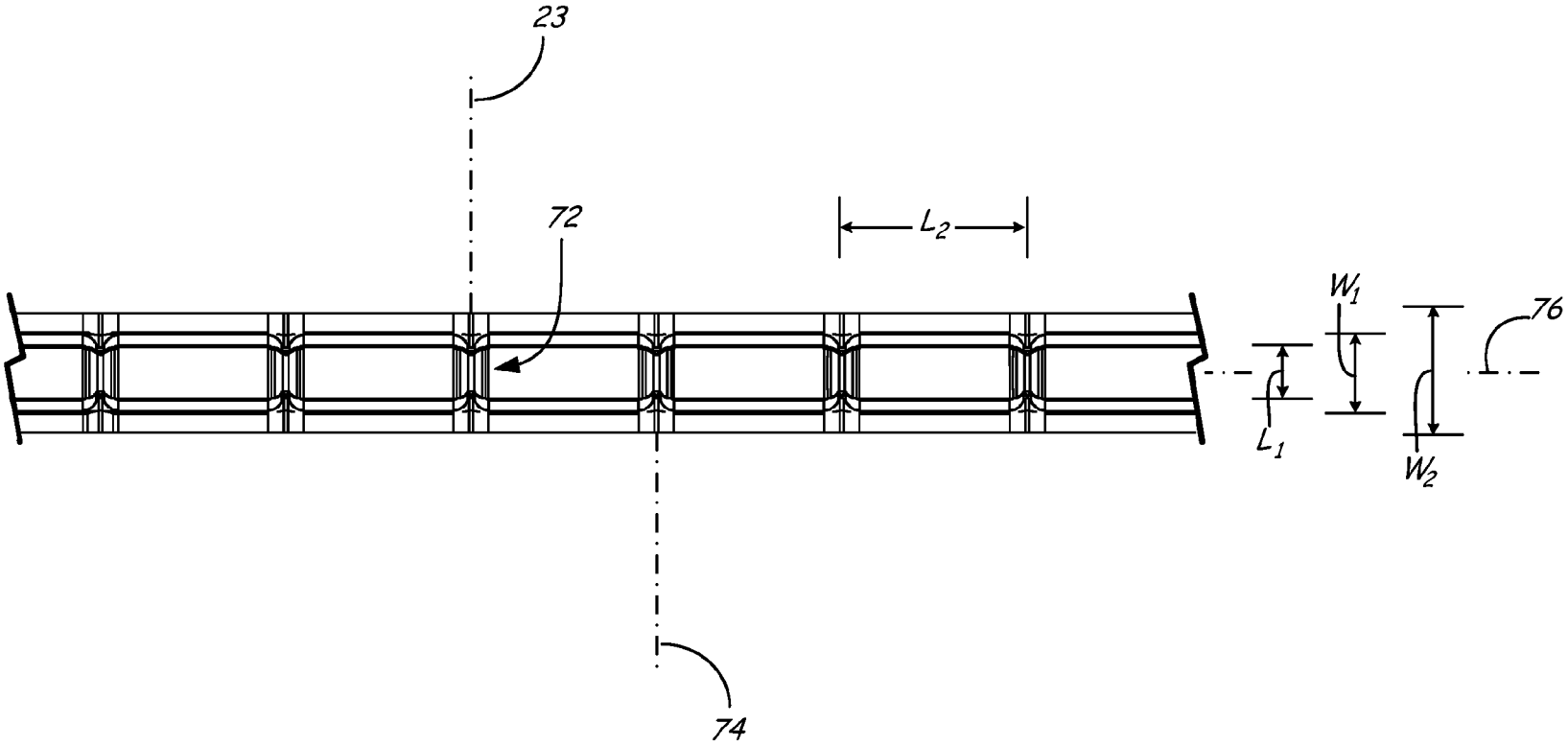
FIG. 5B is an isolation top plan view of a portion of a furring channel framing member of the present invention.
Figure 6:
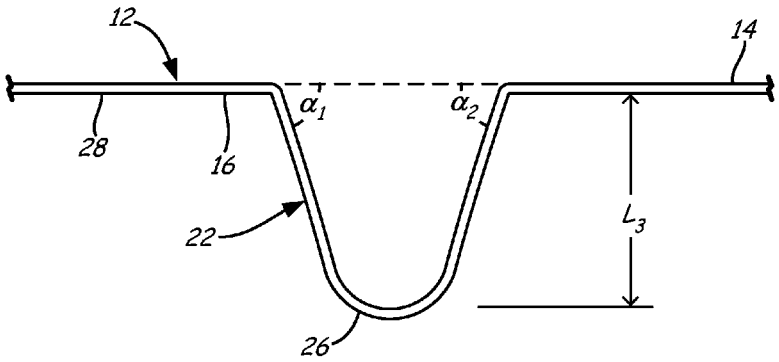
FIG. 6 is a schematic illustration of a portion of a furring channel framing member of the present invention.

FIG. 2 is an enlarged view of a portion of assembly 2 to more clearly depict the interaction of furring channel framing member 10 with structural framing stud 4. In the illustrated embodiment, furring channel framing member 10 is secured to a mounting surface 6 of structural framing stud 4, such that framing member 10 establishes an outer surface 14 to which finishing materials may be secured to assembly 12 and spaced from structural framing stud 4. As indicated above, the provision of a finishing material securement surface that is spaced from the structural framing support offers several advantages, including acoustical benefits.

Furring channel framing member 10 includes a base 12 having an outer surface 14 and an inner surface 16, first and second side edges 18, 20, and a length "L". Base 12 further includes one or more first creases 22 extending between first and second side edges 18, 20 and arrayed along length "L". The array of a plurality of first creases 22 defines discrete base zones 24 between sets of adjacent first creases 22.

In some embodiments, first creases 22 extend substantially transverse to length "L" of base 12, substantially perpendicularly between first and second side edges 18, 20. First creases 22 may extend completely across base 12 between first and second side edges 18, 20. Preferably, first creases 22 have a first crease length $L_1$ that is at least 50%, and more preferably at least 80% of a width dimension "$W_1$" of base 12.

First creases 22 may be spaced apart along length "L" by equal or unequal spacing dimensions "$L_2$" so as to provide framing member 10 with a desired degree of flexibility about respective pivot axes established in part by first creases 22. In some embodiments, such spacing dimension "$L_2$" may be, for example, four inches, six inches, or eight inches. However, it is contemplated that a variety of spacing dimensions "$L_2$" may be employed in framing member 10 to accomplish desired flexibility characteristics.

First creases 22 may each be arranged transverse to longitudinal axis 76, or may instead be variously oriented between first and second side edges 18, 20. Typically, however, first creases 22 are employed to assist in establishing a pivot axis 23 at least partially transverse to longitudinal axis 76 for bending frame member 10 thereabout to form an overall curved configuration for framing member 10. It is contemplated that framing member 10 may be fabricated from a single piece of metal, such as steel, and may be formed from various thickness gauges, including, for example, between thickness gauges of 0.012 and 0.025 in. Greater material thicknesses may require reduced spacing dimensions "$L_2$" in order to effectuate sufficient flexibility for framing member 10. Therefore, generally, spacing dimension "$L_2$" may be increased as the gauge thickness of framing member 10 is decreased.

First creases 22 each include a first apex 26 that is spaced from a base plane 28 of a portion of base 12 adjacent to first crease 22 by a first apex dimension $L_3$. First creases 22 may be formed in base 12 with respective first apexes 26 extending first apex dimension $L_3$ outwardly from outer surface 14 or inwardly from inner surface 16. Most typically, however, first creases 22 are formed with respective first apexes 26 formed inwardly from inner surface 16, such that finishing materials (e.g. drywall, plywood, etc.) may be applied flush to outer surface 14 of framing member 10. First creases 22 may have angles $\alpha_1$ and $\alpha_2$ of between about 15 and about 75°. It has been determined by the Applicant that such crease angles provide strength and rigidity to framing member 10 both in an unstressed initial configuration, as well as subsequent to bending and forming operations wherein first creases 22 are altered in configuration with respect to an initial, pre-formed configuration. Moreover, such first creases 22 facilitate bending of framing member 10 about respective pivot axes established at least partially by first creases 22.

Figure 7:
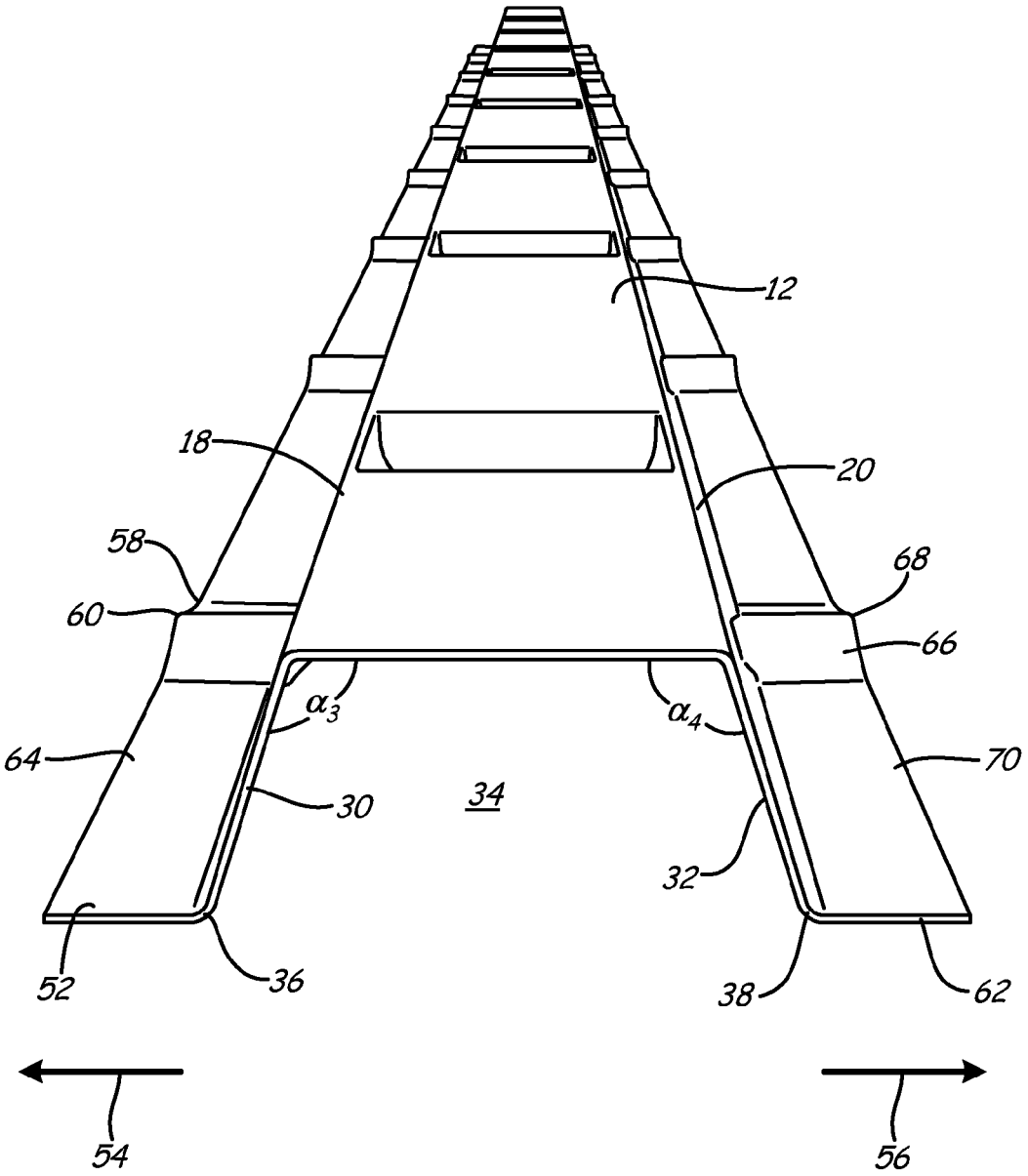
FIG. 7 is a front perspective view of a furring channel framing member of the present invention.

Framing member 10 further includes first and second legs 30, 32 extending respectively from first and second side edges 18, 20 of base 12 and along length "L" to form a substantially U-shaped channel 34 bounded by base 12 and first and second legs 30, 32. In some embodiments, first and second legs 30, 32 may extend from base 12 in a substantially common direction so as to be substantially parallel to one another. However, as illustrated in FIG. 7, first and second legs 30, 32 may extend from base 12 along respective third and fourth angles $\alpha_3$, $\alpha_4$ which result in somewhat non-parallel orientations for first and second legs 30, 32. Third and fourth angles $\alpha_3$, $\alpha_4$ may generally be between 80-150°, and more preferably between about 90° and 135°. In the illustrated embodiment, $\alpha_3$ and $\alpha_4$ are substantially equal, and are about 100°-130°. Such a configuration for framing member 10 has been found by Applicants to provide a stable, and yet hand-bendable furring channel structure.

Each of first and second legs 30, 32 extend from a respective one of first and second side edges 18, 20 to respective first and second terminus edges 36, 38. In the illustrated embodiment, first and second legs 30, 32 extend continuously throughout length "L". It is also contemplated that one or both of first and second legs 30, 32 may extend discontinuously along length "L".

First leg 30 includes a second crease 40 extending between first side edge 18 at first crease 22 and first terminus edge 36. Second crease 40 includes a second apex 42 that is spaced from a first leg plane 44 of a portion of first leg 30 that is adjacent to second crease 40. In some embodiments, second crease 40 is configured with second apex 42 inwardly positioned from first leg 30, into channel 34. It is contemplated, however, that certain arrangements of framing member 10 may provide second crease 40 with second apex 42 disposed outwardly from first leg 30, out from channel 34. Moreover, it is contemplated that second crease 40 may be formed with similar first and second angles $\alpha_1$, $\alpha_2$ as first crease 22. By positioning second crease 40 at a position of first leg 30 coextensive with first crease 22, the second crease 40 assists in the bendability of framing member 10. Such a result may be particularly observed where second apex 42 is coextensive with first apex 26. However, it is contemplated that second crease 40 may not be coextensive with first crease 22, and may instead be provided at a portion of first leg 30 that is longitudinally spaced from first crease 22.

Second leg 32 includes a third crease 46 extending between second side edge 20 at first crease 22 and second terminus edge 38. Third crease 46 includes a third apex 48 that is spaced from a second leg plane 50 of a portion of second leg 32 that is adjacent to third crease 46. In some embodiments, third crease 46 is substantially similar to second crease 40, and may be formed with third crease 46 disposed outwardly or inwardly from second leg 32 with respect to channel 34. Third crease 46 further assists in the bendability of framing member 10 about the pivot axes 23 established at each of first creases 22.

In some embodiments, second and third creases are respectively formed in first and second legs 30, 32 as a consequence of the formation of first crease 22. In such embodiments, second and third creases 40, 46 may be irregularly configured, and not specifically formed through a dedicated crimping procedure to first and second legs 30, 32. Therefore, it is contemplated that second and third creases 40, 46 may alternatively be irregularly-shaped zones in first and second legs 30, 32 created in the formation of first creases 22.

A first flange 52 extends outwardly from first terminus edge 36 of first leg 30 generally along a first direction 54, and continuously or discontinuously along length "L". A second flange 62 extends outwardly from second terminus edge 38 of second leg 32 along a second direction 56 that is substantially opposite to first direction 54. Second flange 62 may also extend continuously or discontinuously along length "L", such that first and second flanges 52, 62 may be substantially parallel to base 12. With first flange 52 extending continuously or discontinuously along length "L", first and second flanges 52, 62 may act as mounting locations for framing member 10 to a framing structure, such as support structure framing stud 4. Securement may be accomplished by fasteners extending through first or second flanges 52, 62, and being anchored to the framing structure.

First flange 52 includes a fourth crease 58 extending from first terminus edge 36 of first leg 30 at second crease 40. Fourth crease 58 includes a fourth apex 60 that is spaced from a first flange plane 64 of a portion of first flange 52 adjacent to fourth crease 58. Second flange 62 includes a fifth crease 66 extending from second terminus edge 38 of second leg 32 at third crease 46. Fifth crease 66 includes a fifth apex 68 that is spaced from a second flange plane 70 of a portion of second flange 62 that is adjacent to fifth crease 66.

In some embodiments, fourth and fifth creases 58, 66 extend from a coextensive merge point with respective second and third creases 40, 46. In this manner, first crease 22, second crease 40, third crease 46, fourth crease 58, and fifth crease 66, in combination, form a flex joint 72 defining a respective pivot axis 74 that may be substantially transverse to a length axis 76 of framing member 10. Fourth and fifth creases 58, 66 may be similar to second and third creases 40, 46, and may possess similar configurations with similar first and second angles $\alpha_1$, $\alpha_1$ as second and third creases 40, 46. In some embodiments, fourth and fifth apices 60, 68 are displaced outwardly from respective first and second flange planes 64, 70, as illustrated in the drawings. Such an orientation limits obstruction of mounting framing member 10 to a framing structure, wherein first and second flanges 52, 62 may be secured substantially flush with a framing structure.

In some embodiments, first and second creases 22, 40 coextensively meet at a first merge point 78, and first and third creases 22, 46 coextensively meet at a second merge point 80. Additionally, second and fourth creases 40, 58 may coextensively meet at a third merge point 82, while third and fifth creases 46, 66 may coextensively meet at a fourth merge point 84. In such an arrangement, each flex joint 72 is comprised of a plurality of pre-formed creases coextensively meeting with one another to form a cooperating location to facilitate hand-bendability of framing member 10 about pivot axis 74. The combination and coextension of each of the pre-formed creases enables a hand-bendable flex joint in a relatively rigid framing member 10. For example, it has been determined by the Applicants that flex joints 72, as described herein, facilitate a hand-bendable framing member 10 that is fabricated from a single piece of stamped metal having a thickness gauge of 0.010-0.025 in. Moreover, such combination of creases not only provide the flexibility characteristics for hand bendability of framing member 10 about respective pivot axes 74, but also provide a desired degree of strength in retaining a designated shape of framing member 10. Applicant has determined that the multiple pre-formed creases, coextensively meeting at respective merge points 78, 80, 82, 84 at their respective junctions assists in strengthening and minimizing the latent resiliency of framing member 10. In other words, the pre-formed configuration of creases 22, 40, 46, 58, 66, as well as their respective merge points 78, 80, 82, 84, assist in eliminating undue resiliency to the overall length of framing member 10. Such a characteristic is important in the field of construction for providing a sturdy and constant-shaped support to which to secure surface finishing materials. Installers may therefore rely upon a custom-created configuration set to framing member 10 by hand-bending furring member 10 at one or more of flex joints 72. Once the custom configuration is achieved, the unique flex joints 72 maintain such pre-set arrangement through self-supporting forces in the creases.

For the purposes hereof, the term "pre-formed" is intended to mean creases that are formed in member 10 in the fabrication process, and not as a result of shaping member 10 into a curved configuration. The pre-formed creases of the present invention are provided with specific geometries to provide the bendability and strength characteristics noted above. Accordingly, the pre-formed creases described herein are to be distinguished from defects, failures, or fatigue points or zones developed in an article as a result of post-manufacture bending or curving.

For the purposes hereof, the term "crease" is intended to mean a fold or corrugation in the respective body portion of the framing member, wherein the fold or corrugation forms one or more apices that are spaced from a plane of the body surface adjacent to such crease. Therefore, the term "creases" is intended to mean an intentional folding or corrugating of one or more walls of the framing member. Depending upon the thickness and/or inherent flexibility of the framing member being creased, the creases may exhibit one or more apices having an apex height of, for example, between 2-20 mm.

For the purposes hereof, the term "coextensive" or "coextensively" is intended to mean two or more creases that meet at a merge point or structure, with the at least two creases being separated only by such merge point or structure. The term "coextensive" or "coextensively" may include two or more creases meeting at a merge point or structure, and that define respective apices that are each contained in a single plane.

For the purposes hereof, the term "merge point" or "merge structure" is intended to mean a structure and/or a portion of the framing member that is interposed between two or more coextensive creases. As an example, the merge point or merge structure may be defined as the intersection of creases formed in the framing member.

In some embodiments, an array of a plurality of flex joints 72 may be spaced apart along length "L", to define one or more discrete base zones 24 between sets of two adjacent flex joints 72. Such flex joints may be spaced apart by any desired spacing dimension to accomplish the desired degree of flexibility to framing member 10. Flex joints 72, for example, may be spaced apart along length "L" by example spacing dimensions of four, six, or eight inches.

It is contemplated that framing member 10 may be hand-bendable at one or more flex joints 72 about the respective pivot axes 74. Framing member 10 may be hand-bendable in either direction about a respective pivot axes 74 to render a curvilinear configuration for framing member 10. For example, framing member 10 may be custom-modified by the installer to obtain a curvilinear configuration with a "flange out" orientation in which first and second flanges 52, 62 are outwardly circumaxially arranged, or "flange in", in which first and second flanges 52, 62 are inwardly circumaxially oriented. Moreover, frame member 10 may be custom-formed to accomplish complex curvilinear formations, as may be required per application.

Figure 8:
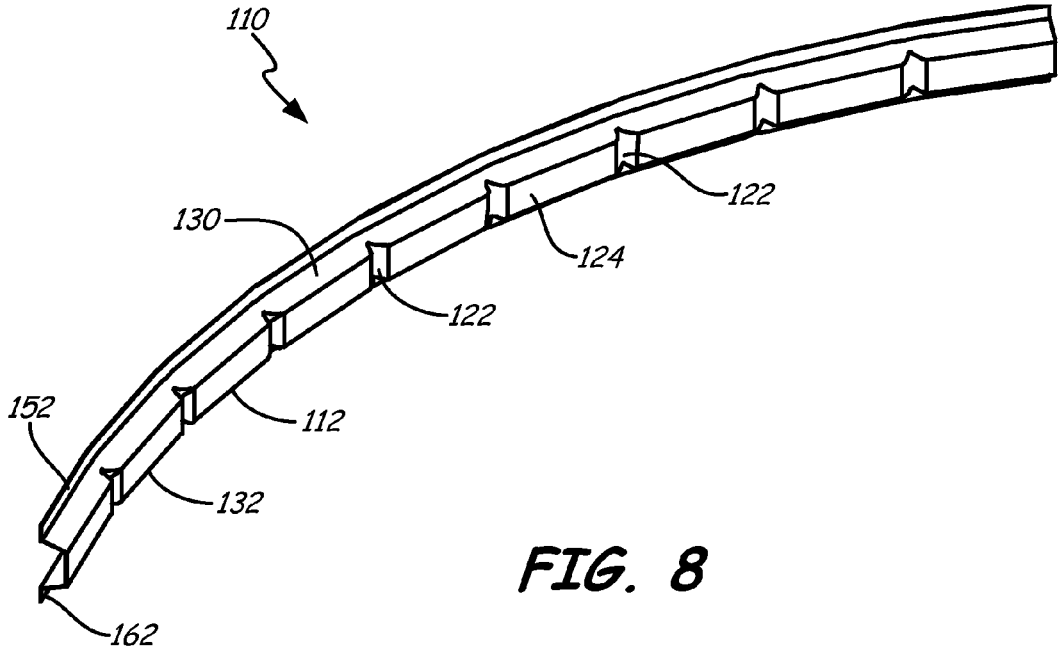
FIG. 8 is a perspective view of a furring channel framing member of the present invention.
Figure 9:
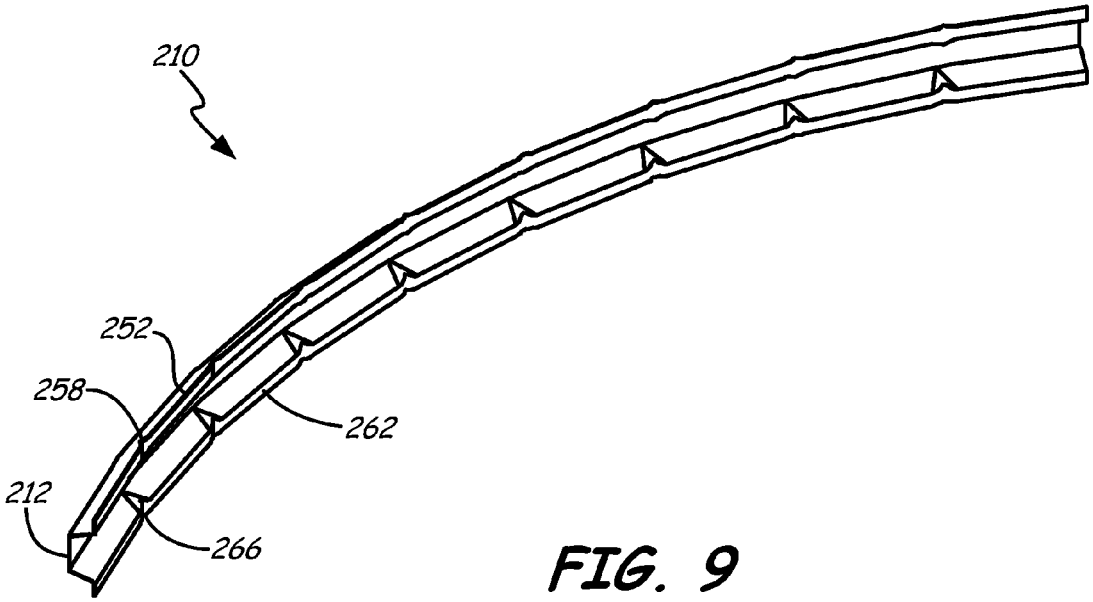
FIG. 9 is a perspective view of a furring channel framing member of the present invention.
Figure 10:
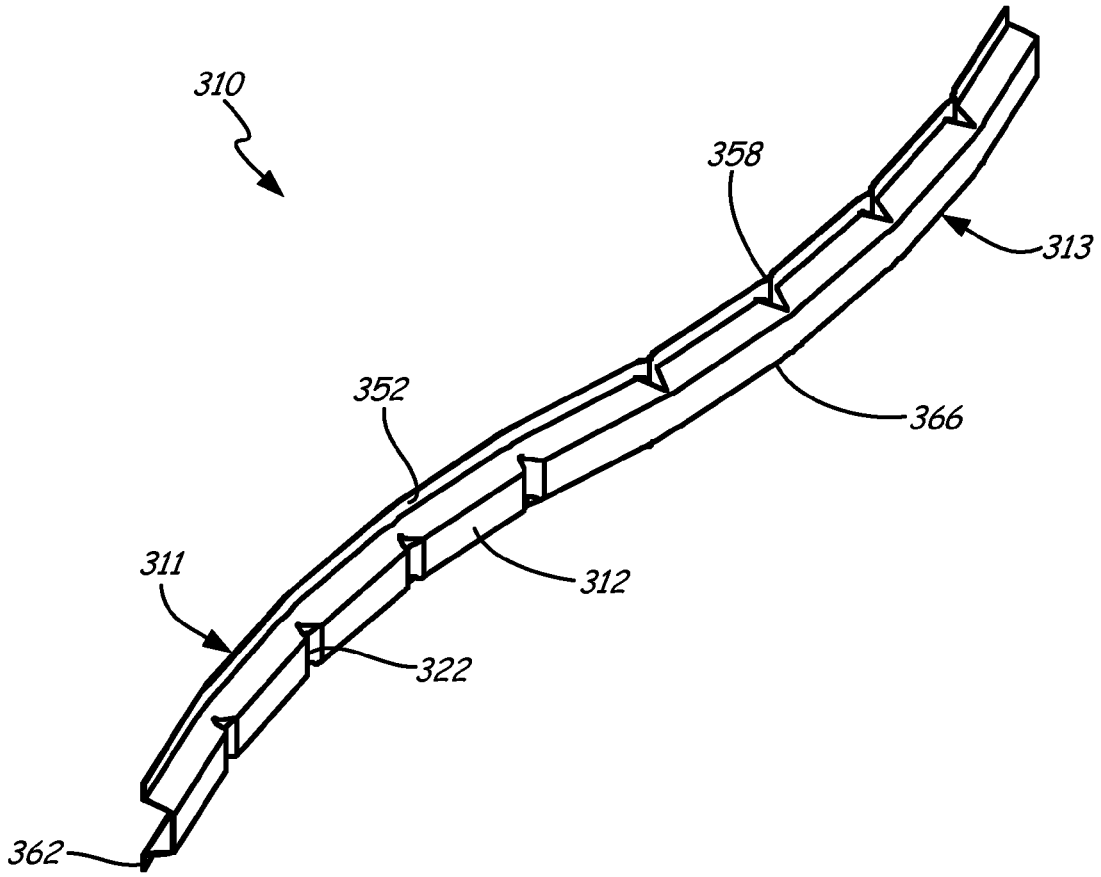
FIG. 10 is a perspective view of a furring channel framing member of the present invention.

Additional embodiments of the invention are illustrated in FIGS. 8-10, in which framing members 110, 210, and 310 may be configured with a custom curvilinear arrangement induced by the size and spacing of creases placed at various portions of the respective framing member. With reference to FIG. 8A, a "flange out" configuration for framing member 110 positions flanges 152, 162 on the outside of the curve for framing member 110, and base 112 on the inside of the curve. Furring channel framing member 110 begins as a linear member that is brought into a curvilinear configuration by crimping base 112 at first creases 122. The array of a plurality of first creases 122 defines discrete base zones 124 between sets of adjacent first creases 122. First creases 122 may be similar to first creases 22 described hereinabove, but may be employed without counterbalancing creases in flanges 152, 162 with the resultant effect upon furring channel framing member 110 being to shorten base 112 in relation to flanges 152, 162. Such length difference, caused by the creases in base 112 (and optionally first and second legs 130, 132) induces a curve to framing member 110 with base 112 on the inside of the curve. In typical applications, furring channel framing member 110 is oriented with flanges 152, 162 for attachment to framing studs or joists to establish a concave finishing surface for mounting of wall or ceiling finishing materials to base 112.

The radius of curvature of framing member 110 may be controlled by the depth of first creases 122, as measured by the first apex dimension $L_3$, and/or the spacing of first creases 122 along length L of framing member 110. Those of ordinary skill in the art understand that increased frequency and/or first apex dimension $L_3$ of the first creases 122 at base 124 correspondingly reduces the radius of curvature of furring channel framing member 110. The overall curvature of framing member 110 may therefore be customized as a function of the spacing and size of first creases 122. While the "flange out" arrangement of framing member 110 may typically be employed with flanges 152, 162 oriented for securement to a wall or ceiling support structure, such as joists or studs, it is contemplated that framing member 110 may instead be employed for a convex wall or ceiling surface with base 112 oriented for securement to the wall or ceiling support structure.

A "flange in" curvilinear furring channel framing member 210 is illustrated in FIG. 9, wherein the inside radius of framing member 210 is at flanges 252, 262, and the outside radius is at base 212. Framing member 210 may typically be employed by securing flanges 252, 262 to wall or ceiling framing structures, such as joists or studs, to establish a convex surface at base 12 against which to secure finishing material such as Gypsum board or the like. To accomplish the curvilinear configuration illustrated in FIG. 9, flange creases 258, 266 are formed in flanges 252, 262 in a similar manner and configuration as that described above with respect to fourth and fifth creases 58, 66 of framing member 10. The creasing of flanges 252, 262 shortens the longitudinal length of flanges 252, 262 with respect to base 212, thereby forming the "flange in" curvilinear configuration of framing member 210 illustrated in FIG. 9.

As described above with reference to furring channel framing member 110, the curvilinear configuration of furring channel framing member 210 may be defined by the size and spacing of flange creases 258, 266. A predetermined curve for framing member 210 may therefore be accomplished by appropriately sizing and spacing flange creases 258, 266. While flange creases 258, 266 are illustrated in FIG. 9 in pair sets, it is contemplated that other arrangements for the array of creases 258, 266 may be useful in certain applications of framing member 210. For example, flange creases 258, 266 may be staggered along the length dimension L of framing member 210, and one of flanges 252, 262 may include a greater or lesser number, sizing, or spacing of creases than the counterpart flange 252, 262. Such an approach may be appropriate in the event that complex curvatures for framing member 210 are desired.

A further embodiment is illustrated in FIG. 10, wherein furring channel framing member 310 exhibits an "s-curve" configuration as the result of first creases 322 applied in base 312 along only a first portion 311 of the length L of framing member 310, along with flange creases 358, 366 applied only to a second portion 313 of the length L of framing member 310. First creases 322 in base 312 presents a "flange out" configuration for first portion 311, while flange creases 358, 366 form a "flange in" curvature at second portion 313 of framing member 310. The compound curve of framing member 310 may typically be applied to wall or ceiling framing structures, such as studs or joists, with flanges 352, 362 of furring channel framing member 310 being secured to such wall or ceiling framing structures. Framing member 310 therefore presents a compound curved surface at base 312 against which wall or ceiling finishing materials may be secured to establish a compound-curved wall or ceiling surface.

The invention has been described herein in considerable detail in order to comply with the patent statutes, and to provide those skilled in the art with the information needed to apply the novel principles and to construct and use embodiments of the invention as required. However, it is to be understood that various modifications may be accomplished without departing from the scope of the invention itself.

What is claimed is:

1. A furring channel framing member, comprising:

a base having an outer surface and an inner surface, first and second side edges, a length, and a first crease extending between said first and second side edges and having a first apex spaced from a plane of a portion of said base adjacent to said first crease;

first and second legs extending respectively from said first and second side edges of said base and along said length to form a channel bounded by said base and said first and second legs, each of said first and second legs extending from a respective one of said first and second side edges to respective first and second terminus edges, said first leg having a second crease extending between said first side edge at said first crease to said first terminus edge, said second crease having a second apex spaced from a plane of a portion of said first leg adjacent to said second crease, said second leg having a third crease extending between said second side edge at said first crease to said second terminus edge, said third crease having a third apex spaced from a plane of a portion of said second leg adjacent to said third crease;

a first flange extending outwardly from said terminus edge of said first leg along a first direction, said first flange having a fourth crease extending from said terminus edge of said first leg at said second crease, said fourth crease having a fourth apex spaced from a plane of a portion of said first flange adjacent to said fourth crease, said first, second, third, and fourth creases together forming a flex joint;

a second flange extending outwardly from said terminus edge of said second leg along a second direction that is substantially opposite to said first direction, wherein said first and second flanges are substantially parallel to said base, said second flange having a fifth crease extending from said terminus edge of said second leg at said third crease, said fifth crease having a fifth apex spaced from a plane of a portion of said second flange adjacent to said fifth crease, wherein said fifth crease forms a portion of said flex joint, wherein said first and second creases coextensively meet at a first merge point, said first and third creases coextensively meet at a second merge point, said second and fourth creases coextensively meet at a third merge point, and said third and fifth creases coextensively meet at the fourth merge point.

2. A furring channel framing member as in claim 1, including an array of a plurality of said flex joints spaced apart along said length, and defining one or more discrete zones between adjacent sets of two of said flex joints.

3. A furring channel framing member as in claim 2 wherein said flex joints are spaced apart by a spacing dimension selected from the group consisting of four, six, and eight inches.

4. A furring channel framing member as in claim 1 integrally formed from a single piece of metal.

5. A furring channel framing member for use with joists or studs of a structural support framework for a wall or ceiling, said furring channel framing member comprising:

a base having an outer surface and an inner surface, first and second side edges, and a length;

first and second legs extending respectively from said first and second side edges of said base and along said length to form a channel bounded by said base and said first and second legs, each of said first and second legs extending from a respective one of said first and second side edges to respective first and second terminus edges;

a first flange extending outwardly from said terminus edge of said first leg along a first direction;

a second flange extending outwardly from said terminus edge of said second leg along a second direction that is substantially opposite to said first direction, wherein said first and second flanges are substantially parallel to said base; and a first crease in said base extending between said first and second side edges and having a first apex spaced from a plane of a portion of said base adjacent to said first crease, a first leg crease extending from the first side edge to the first terminus edge of said first leg, and a flange crease extending from said terminus edge of said first leg along a first direction, said flange crease having a second apex spaced from a plane of a portion of said first flange adjacent to said flange crease, wherein said first leg crease and said flange crease are coextensive, and wherein said furring channel framing member forms a curvilinear surface extending between the joists or studs of the structural support framework.

6. A furring channel framing member as in claim 5, including at least one of an array of first creases and an array of flange creases forming a predetermined curvilinear surface.

7. A furring channel framing member as in claim 6 wherein said array of flange creases are disposed in both said first and second flanges.

8. A furring channel framing member as in claim 7 wherein said array of flange creases includes discrete sets of pairs of flange creases with respective second apices defining first and second line segments, with said first and second line segments being linearly aligned along a single line.

9. A furring channel framing member as in claim 5, including an array of first creases and an array of flange creases.

10. A furring channel framing member for use with joists or studs of a structural support framework for a wall or ceiling, said furring channel framing member comprising:

a thin strip extending longitudinally forming a base;

first and second spaced apart sides extending longitudinally and extending in a similar outward direction from the side edges of said base;

a first flange extending longitudinally along an outer edge of said first side and extending outwardly from said first side;

a second flange extending longitudinally along an outer edge of said second side and extending outwardly from said second side, wherein said second flange opposes said first flange;

a first crease formed in said first flange and having a first flange crease apex offset from a planar surface of said first flange, a second crease formed in said first side and having a first side crease apex offset from a planar surface of said first side, a third crease formed in said base and having a base crease apex offset from a planar surface of said base, a fourth crease formed in said second side and having a second side crease apex offset from a planar surface of said second side, and a fifth crease formed in said second flange and having a second flange crease apex offset from a planar surface of said second flange, wherein said first crease is coextensive with said second crease, said second crease is coextensive with said third crease, said third crease is coextensive with said fourth crease, and said fourth crease is coextensive with said fifth.

11. A furring channel framing member as in claim 10, wherein said first crease, second crease, third crease, fourth crease and fifth crease together form a flex joint.

12. A furring channel framing member as in claim 11, further including an array of a plurality of said flex joints spaced apart along a length, and defining one or more discrete zones between adjacent sets of two of said flex joints.

13. A furring channel framing member as in claim 12, wherein said flex joints are spaced apart by a spacing dimension selected from the group consisting of four, six, and eight inches.

14. A furring channel framing member as in claim 10, wherein said framing member is integrally formed from a single piece of metal.

15. A furring channel framing member as in claim 10, wherein said second crease, third crease and fourth crease project inwardly and said first crease and fifth crease project outwardly.

16. A furring channel framing member as in claim 15, wherein said framing member is integrally formed from a single piece of metal.

* * * * *